US006692376B2

(12) United States Patent
Kosovac et al.

(10) Patent No.: US 6,692,376 B2
(45) Date of Patent: Feb. 17, 2004

(54) GOLF CLUB

(75) Inventors: Milana Kosovac, New York, NY (US); Paul Specht, Wilmette, IL (US)

(73) Assignee: Chapel Golf, Inc., North Palm Beach, FL (US)

( * ) Notice: Subject to any disclaimer, the term of this patent is extended or adjusted under 35 U.S.C. 154(b) by 0 days.

(21) Appl. No.: 10/218,886

(22) Filed: Aug. 14, 2002

(65) Prior Publication Data

US 2003/0073509 A1 Apr. 17, 2003

Related U.S. Application Data

(63) Continuation-in-part of application No. 09/618,076, filed on Jul. 17, 2000.

(60) Provisional application No. 60/148,011, filed on Aug. 10, 1999.

(51) Int. Cl.[7] ..... A63B 53/04; A63B 53/02

(52) U.S. Cl. ..... 473/312; 473/341; 473/350

(58) Field of Search ..... 473/342, 340–341, 473/312, 313, 314, 304, 347, 348, 330, 349, 350

(56) References Cited

U.S. PATENT DOCUMENTS

| | | | | |
|---|---|---|---|---|
| 1,319,802 A | | 10/1919 | Shea | |
| 3,042,405 A | | 7/1962 | Solheim | |
| 3,220,733 A | | 11/1965 | Saleeby | |
| 3,387,844 A | | 6/1968 | Shippee | |
| 3,516,674 A | | 6/1970 | Scarborough | |
| 4,063,733 A | | 12/1977 | Benedict | |
| 4,113,249 A | | 9/1978 | Beery | |
| 4,128,244 A | * | 12/1978 | Duclos | 473/242 |
| 4,162,074 A | | 7/1979 | Thomson | |
| 4,444,395 A | | 4/1984 | Reiss | |
| 4,521,022 A | * | 6/1985 | Schmidt | 473/330 |
| 4,630,827 A | * | 12/1986 | Yoneyama | 473/348 |
| 4,697,814 A | * | 10/1987 | Yamada | 473/348 |
| 4,793,616 A | * | 12/1988 | Fernandez | 473/347 |
| 4,912,830 A | | 4/1990 | Vesligaj | |
| 4,915,385 A | | 4/1990 | Anderson | |
| 4,979,744 A | | 12/1990 | Alcala | |
| 5,004,242 A | * | 4/1991 | Iwanaga et al. | 473/347 |
| 5,090,698 A | | 2/1992 | Kleinfelter | |
| 5,127,653 A | | 7/1992 | Nelson | |
| 5,137,275 A | | 8/1992 | Nelson | |
| 5,277,866 A | | 1/1994 | Wright | |
| 5,308,067 A | | 5/1994 | Cook | |

(List continued on next page.)

FOREIGN PATENT DOCUMENTS

| | | |
|---|---|---|
| EP | 0 965 366 A1 | 12/1999 |
| FR | 2523854 A | 9/1983 |
| GB | 2309390 A | 7/1997 |
| JP | 2336123 A | 10/1999 |
| TW | 362523 A | 6/1999 |
| WO | WO 99/24124 A | 5/1999 |
| WO | WO 01/10513 A | 2/2001 |
| WO | WO 01/74457 A | 10/2001 |

OTHER PUBLICATIONS

Patent Abstracts of Japan, vol. 018. No. 451, regarding Japanese Patent Publication JP–A–6–142240 (Kurien K.K.) (Aug. 23, 1994).

U.S. patent application Ser. No. 09/618,076 Kosovac, filed Jul. 17, 2000.

*Primary Examiner*—Stephen Blau
(74) *Attorney, Agent, or Firm*—Leydig, Voit & Mayer, Ltd.

(57) ABSTRACT

A golf club having enhanced balance and sensory feedback that includes: a shaft, a hosel and a body in an integrated assembly of relatively low mass density; and, a shell having distal toe and heel portions of relatively high mass density, a web in the body between the toe and heel portions and an armature extending up from the web connecting the integrated body, hosel and shaft.

26 Claims, 6 Drawing Sheets

U.S. PATENT DOCUMENTS 5,382,019 A 1/1995 Sneed
5,388,827 A 2/1995 Reynolds, Jr.
5,501,461 A 3/1996 Donofrio
5,536,011 A 7/1996 Gutowski
5,558,332 A 9/1996 Cook
5,797,176 A 8/1998 Rose et al.
5,842,935 A 12/1998 Nelson
5,938,543 A 8/1999 McGeeney et al.
6,083,115 A 7/2000 King
6,095,931 A 8/2000 Hettinger et al.
6,328,662 B1 12/2001 Huang
6,344,002 B1 * 2/2002 Kajita ..... 473/330
2001/0029209 A1 10/2001 Kosovac

* cited by examiner

GOLF CLUB

REFERENCE TO RELATED PATENT APPLICATIONS

This patent application is a continuation-in-part of copending U.S. patent application Ser. No. 09/618,076, filed Jul. 17, 2000, which claims the benefit of U.S. Provisional Patent Application No. 60/148,011, filed Aug. 10, 1999.

TECHNICAL FIELD OF THE INVENTION

The present invention relates to the field of golf clubs, and more particularly, to the field of golf putters.

BACKGROUND OF THE INVENTION

The golf club art has seen substantial creative work in mass distribution, clubhead configuration, audible and sensory feedback and the like. Much has been done in golf club design in an effort to improve the performance of the golfer or otherwise enhance the golfing experience. U.S. Pat. No. 3,042,405 to Karsten Solheim discloses a golf putter having internal weights at the heel and toe ends of the club. The end blocks are connected together by one or two thin face plates and a bar that supports a hosel.

U.S. Pat. No. 4,444,395 to Morton Reiss discloses a golf putter having an elongate head comprising three sections. The head includes a low mass center section with a length at least 1½ times the ball diameter and two, more massive, end sections. The three sections have substantially the same transverse cross section forming a single continuous blade. A major portion of the mass is in the end portions which may be connected together longitudinally through the center section by steel pins. The club shaft is secured to the head centrally.

Another approach to putter shape, size and weight distribution is found in U.S. Pat. No. 5,938,543 to McGeeney et al. where a center section of the head is of relatively low mass density, non-metallic material. The head has higher density metallic heel and toe portions with an integrally formed high density hosel extending upwardly from the heel portion.

Numerous other golf clubs have been provided in the prior art that have been described by the designers as providing enhancements of sound, balance, or human factor considerations.

Some golf clubs known in the art are said to have an awkward "feel" when striking a golf ball, believed to be in part because of the distribution of weight within the clubhead. In addition, while the prior art has provided other golf clubs that are said to have a proper feel and to be properly balanced, many of these golf clubs are unattractive and the physical appearance is distractive. Some configurations do not provide the optimum perspective to the golfer as the ball is addressed or a helpful audible or tactile response as the club strikes the ball. There thus exists an ongoing need in the art for a golf club that has an optimum balance and feel, an appearance and a sighting perspective which support concentration and audible and tactile responses that optimize the relationship between golfer and putter.

It is a general object of this invention to provide a club that optimizes the foregoing criteria.

Specifically, the general objects of the invention include the creation of a golf club, especially a putter, that provides audible and sensory feed-back to the golfer for improved performance. The golfer, golf club and golf ball are connected during the swing and at impact. Golf clubs made according to this invention provide superior sensitivity to the swing and impact, a dynamic sense of balance and an enhanced "feel" which is fed back visually and by tactile sensations indicative of stroke quality. The characteristics of the clubhead are believed to be further enhanced from integration of a shaft of low mass density material and a low mass density hosel and body with a shell having a unique web extending through the body that is integrated with high mass density heel and toe polar shell portions. The performance of the unique body, hosel and shaft configuration is augmented by the other structural and functional features of the invention as described and claimed.

SUMMARY OF THE INVENTION

The present invention provides a well-balanced golf club that satisfies the foregoing general objects. The golf club of the invention includes a shaft that has a handle end and a clubhead end. Means in the nature of a hosel integrates the clubhead end of the shaft to a clubhead that comprises two basic elements. The two basic clubhead elements are (1) a body, also sometimes called an insert, of relatively lightweight material defining a striking surface, an upper aligning surface integrally related to a flat sighting surface on the hosel connecting the shaft and handle and, and (2) a shell including polar weighting comprising relatively massive distal portions, and an interconnecting medial portion comprising a web in the body and an armature connected to the web within the body and extending into the hosel. In a preferred embodiment, the low mass body is secured between the relatively high mass heel and toe portions and is configured for optimum dynamic balance, inertial stability, sensory golfer feed-back and related enhanced sighting. The body portion, shaft and hosel are preferably of low mass density materials compared to the shell to provide an optimum polar mass distribution.

The medial portion of the shell comprising a thin web in the lightweight body and a hosel armature extending therefrom integrates the total body, hosel and shaft and should provide improved performance of the putter and enhanced sensory feedback to the golfer upon striking the ball.

In one preferred embodiment the hosel, or connecting means, is strategically located on the body, close to the heel portion and of the same low density material as the body and shaft, resulting in advantages of optimum weight distribution. The body portion is visible as a flat top surface with an indicium which assists the golfer in addressing the ball and aligning the club and ball for the putt. The configuration of the connecting means or hosel includes a flat alignment surface that has a synergistic relationship to the upper sighting surface of the body and provides body/shaft interaction.

In some preferred embodiments of the invention, the clubhead body portion has a striking surface having a cylindrical or roll face configuration the longitudinal axis of which is aligned with the longitudinal axis of the clubhead. The striking surface extends between the top surface and a bottom surface that forms a portion of the sole of the club. The striking surface is preferably an arcuate segment that correlates with the sweet spot or center of gravity and the top and bottom surfaces. For the putting stance of most golfers, this surface minimizes skipping or jumping and causes the ball to hug the green. It is a portion of the striking face of the clubhead.

In a preferred embodiment, the shaft and body portion are connected through the hosel connecting means and include a reinforcing armature. The body portion is a generally rectilinear blade having an exposed striking surface, a sole surface, a sighting top surface and may include a rearward sole back shelf. The back configuration of the toe and heel portions may conform to the back of the body. In another preferred embodiment the rear of the body portion is cut-away to define a rear sole shelf to further augment the polar mass distribution while the toe and heel portions are not cut away, thus providing augmented polar distribution. However, the invention provides advantages in blade-type putters with or without a cut-away back and in mallet-type putters having various back configurations. The hosel connecting means may be straight or may include a single or double offset portion to provide an upper hosel portion aligned with the shaft axis and the front of the clubhead to align with the striking surface and to establish a shaft angle of about 72° to the sole, called the "lie" angle.

Other features and objects of the invention will be apparent from the following description of the invention and its embodiments.

DESCRIPTION OF THE DRAWINGS

For clarity, the following nomenclature, adapted from the prior art, will be employed in the description. The ball striking surface or "strike face" of the clubhead, which is intended to hit the golf ball, is located on the "front" of the clubhead. The terms "top" or "upper" and "bottom" or "lower" assume that the clubhead is oriented as it would be if the golf club were held by a golfer in an at rest position, i.e., the bottom of the clubhead, also called the sole, would contact the ground when at rest. The heel of the clubhead is located longitudinally opposite the toe of the clubhead. The heel portion of the clubhead would be nearest the golfer when the golfer holds the club in an at rest position. The term "depth" refers to a dimension extending from the front to the back of the golf club. The terms "length" of the clubhead and "longitudinal" refer to a dimension extending from the heel end to the toe end.

DESCRIPTION OF THE INVENTION

Figure 1:
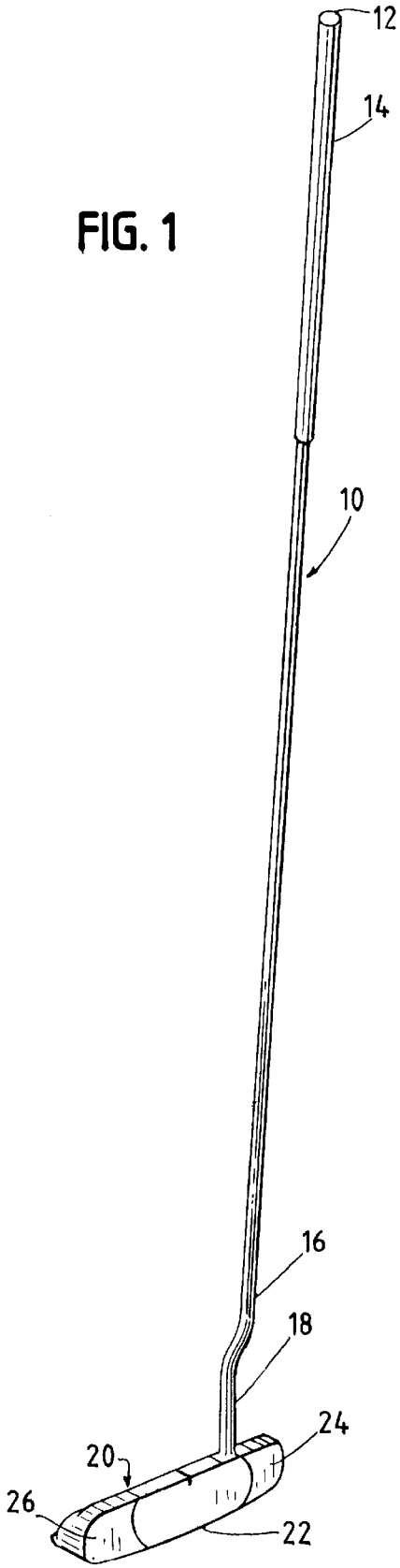
FIG. 1 is an overview perspective of one embodiment of the invention.

Referring now to the drawings and more particularly to FIG. 1, a perspective view of the invention is illustrated comprising generally a shaft 10 having a gripping end 12 with a handle 14 of leather or the like and a clubhead end 16 that has a connecting means 18 in the nature of a hosel integrated with a clubhead 20.

The clubhead 20 has a central body (sometimes referred to as an "insert") 22 of lightweight material with a shell having a heel end 24 and a toe end 26 of relatively heavy, high mass density material.

Various internal configurations for the clubhead are contemplated. Cross sections of several of those configurations are illustrated in FIGS. 6, 7, 12 and 14. In accordance with the invention, the bodies 22, 122, 222 and 322 have a web 54, 154, 254 and 354, respectively, comprising a shell medial portion to obtain the benefits described in the Summary of the Invention. The structural and functional details of those webs are more fully described hereinafter.

The construction of the shaft, hosel connection means and body integrated with an armature and with the web are illustrated in FIGS. 8 and 9–11 and are also described in greater detail hereinafter.

These construction features are herein applied to golf clubs similar to that of FIGS. 9*a*–9*f* of U.S. patent application Ser. No. 09/618,076, and can be applied to the other embodiments of that application by omitting the tubular (cylindrical) cavity thereof and incorporating the longitudinal web in the body (insert) as described herein.

Figure 10:
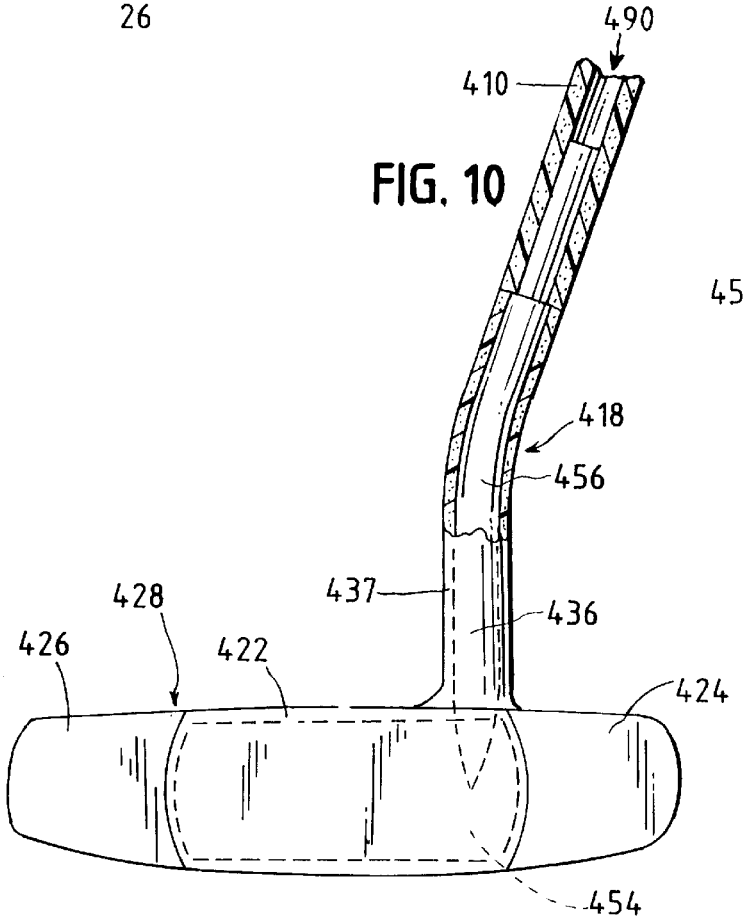
FIG. 10 is a fragmentary front elevation partially in section of an alternate embodiment of the invention shown in FIG. 1 illustrating portions of the web and armature shown in broken lines.

With respect to the integrated shaft, connector and body shown in FIG. 10 hereof and described herein, that construction and method can also be utilized in golf clubs as shown, described and claimed in application Ser. No. 09/618,076. To implement the foregoing, application Ser. No. 09/618,076 is incorporated herein, in its entirety, by reference.

In FIG. 1 hereof the handle 14 may be a leather cover on the player gripping end 12 of shaft 10 or it may be of other materials dictated by the regulations of the PGA or other regulatory organizations. The shaft 10, hosel 18, and body 22 may be of a composite material such as a graphite resin composite or a fiberglass resin composite and may be integrated in a manner explained in greater detail hereinafter. In a preferred embodiment of the invention the connecting means (hosel) 18 and clubhead body 22 are fabricated of a composite material such as a graphite-resin. If the shaft 10 is also of graphite resin composite, the body 22 connecting means 18 and shaft 10 are preferably integrated during fabrication to comprise a continuous composite unit.

Figure 2:
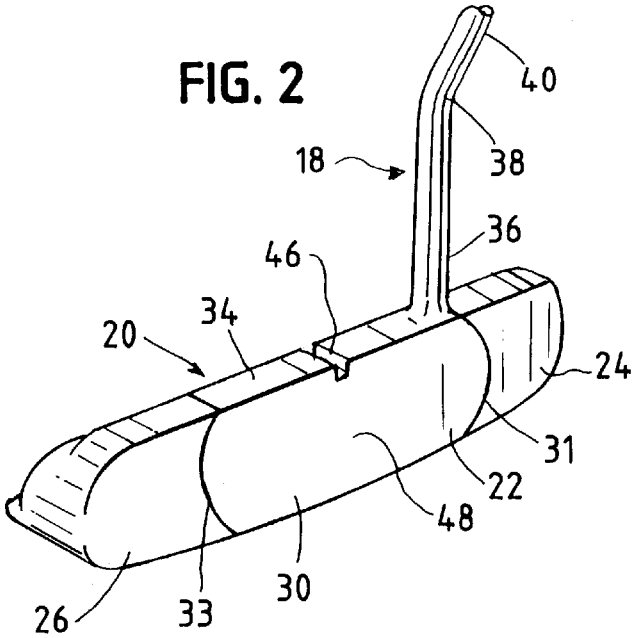
FIG. 2 is a perspective view of the clubhead of one embodiment of the invention shown in FIG. 1.
Figure 3:
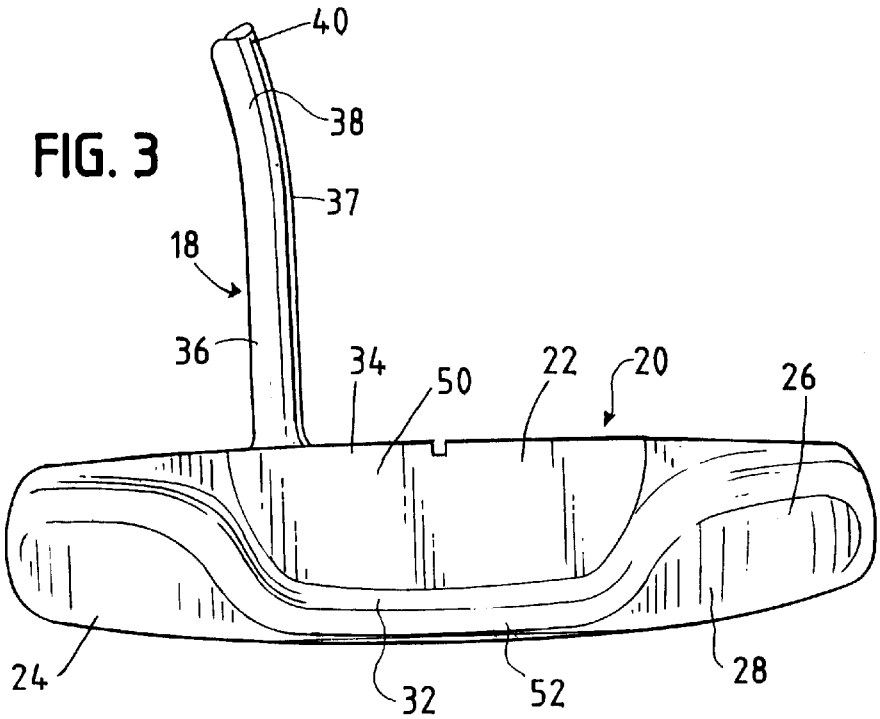
FIG. 3 is a rear elevation of the embodiment of FIG. 2.
Figure 4:
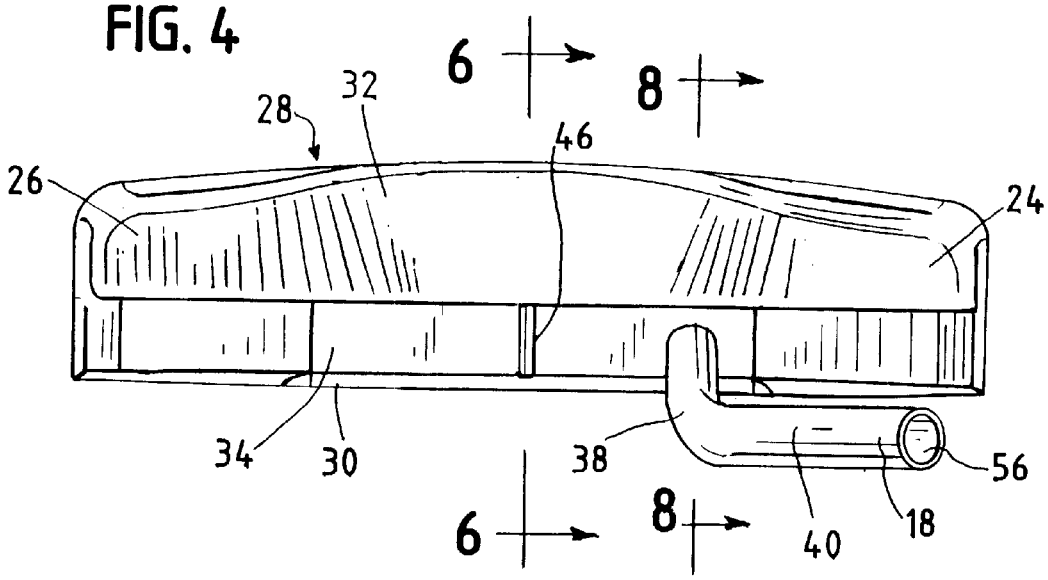
FIG. 4 is a top plan view of the embodiment of the invention shown in FIG. 2.
Figure 5:
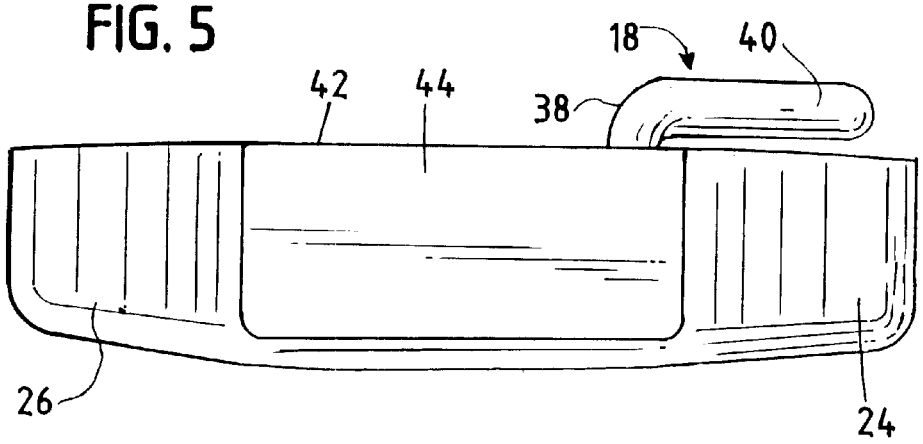
FIG. 5 is a bottom plan view of the embodiment of the invention shown in FIG. 2.

FIG. 2 is an enlarged view of the clubhead and hosel portion of the golf putter of FIG. 1 while FIGS. 3, 4 and 5 are rear, top and bottom views thereof. The front or striking surface 30 of body 22 extends longitudinally of the clubhead between the front surfaces of heel end 24 and toe end 26 of a clubhead shell 28 which together comprise the striking face. The shell 28 is relatively massive, preferably fabricated of a relatively heavy metal such as steel, tungsten, or the like. The shell 28 includes a medial section 32 connecting the toe end 26 and heel end 24 together. In the embodiment shown in FIG. 3, the medial section 32 includes a rear shelf 52 and an upright web within body 22 that is not visible in FIG. 3.

FIG. 4 is a top plan view of the embodiment of FIG. 3 showing a fragment of the hosel 18 extending upwardly from the top face 34 of body 22. The hosel 18 has a portion 36 extending upwardly from the top face 34 of the body 22 which extends into an offset portion 38 extending at a small acute angle to the plane of the striking surface 30 of body 22 for a short distance. An upper portion 40 of hosel 18 lies generally aligned with the top edge joining the striking surface 30 with the top surface 34 of body 22. The upper portion 40 of hosel 18 forms a large acute angle relative to the edge 42 which joins the striking surface 30 with the bottom or sole surface 44 of body 22. The large acute angle defined by the upper portion 40 of hosel 18 is aligned with the clubhead end 16 of shaft 10. The angle of the shaft 10 relative to the longitudinal axis of the clubhead is approximately 72° and is often referred to as the lie angle.

The upper surface 34 of body 22 includes an indicium 46 that, in the preferred embodiment, is a groove formed in the upper surface transverse to the striking surface 30. The groove 46 acts as a sighting aid and is located above an optimum target point 48 indicated by imaginary cross hairs in FIG. 2 on the striking surface 30. The bottom portion 36 of hosel 18 is flattened at the toe side 37 providing an additional alignment aid cooperating with the upper body surface 34 and groove 46. The striking surface 30 of body 22 preferably has circular heel and toe edges 31 and 33 centered on target 48. The longitudinal axis of the shaft 10 is also aligned with that target point 48.

Figure 6:
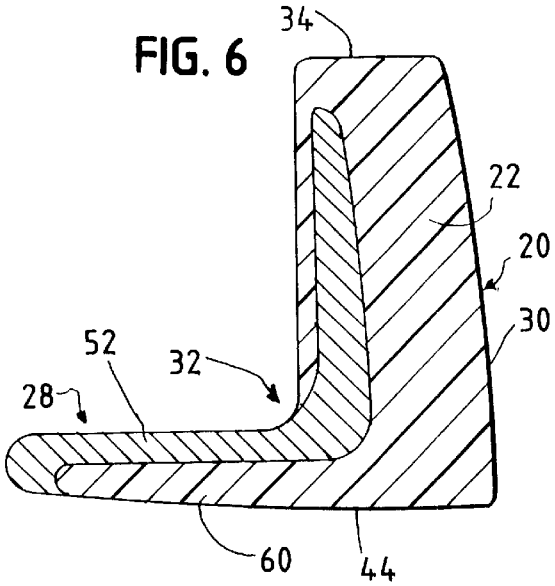
FIG. 6 is a cross-sectional view taken on the line 6—6 of FIG. 4, illustrating one internal configuration for the clubhead forming a part of the embodiment of FIG. 2.
Figure 7:
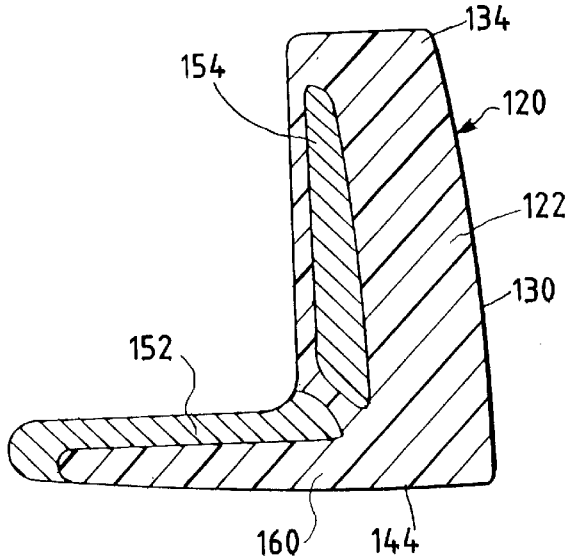
FIG. 7 is a cross-sectional view taken on the line 6—6 of FIG. 4 showing an alternate configuration of the embodiment of the invention shown in FIG. 2.

FIG. 3 illustrates the rear elevation of the clubhead embodiments specifically shown in FIGS. 6 and 7. In those embodiments the rear view or back view of the clubhead shows the rear body surface 50 having a unitary appearance and comprising a nonmetallic material surface such as the graphite resin composite described above. The more massive polar shell portions 24 and 26 are also shown connected by shelf 52. Those preferred embodiments are illustrated in cross sections of the clubhead taken on lines 6—6 and 8—8 of FIG. 4. One preferred embodiment shown in the cross section of FIG. 6 illustrates the clubhead 20 including the clubhead body 22 formed of a nonmetallic material of relatively lighter weight which is formed around a medial section 32 of shell 28. The medial section 32 in the embodiment of FIG. 6 includes the rear shelf 52 already described and an internal web 54 extending upwardly within the nonmetallic body 22. The body 22 has a sole portion 60 under shell shelf 52 and defining the sole surface 44.

Figure 8:
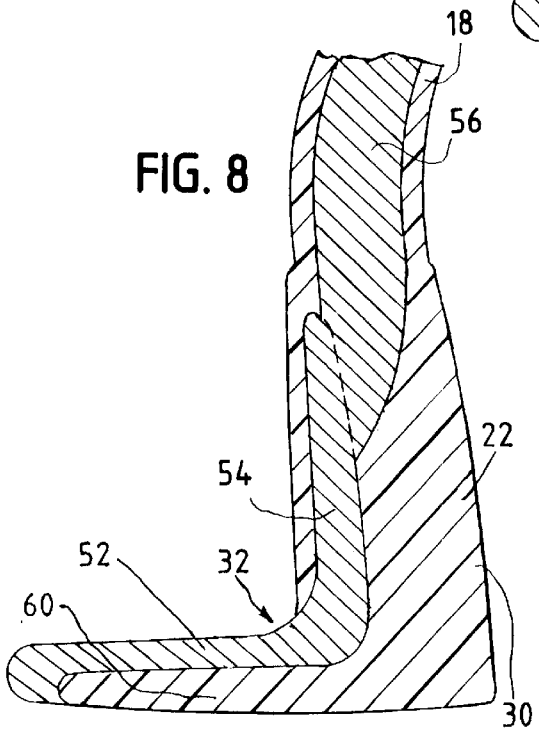
FIG. 8 is a cross-sectional view taken on the line 8—8 of FIG. 4 illustrating the invention of the clubhead and part of the hosel of FIG. 6.

The web 54 is connected to the massive heel end 24 and toe end 26 of shell 28. As shown in FIGS. 8 AND 10, there is an armature 56 of the high mass density material enclosed within the hosel 18 that imparts structural rigidity to the hosel and the integrated body, hosel and shaft in cooperation with the web 54.

It has been found that the web 54 extending between the massive toe end and heel end of the shell 28 and formed in the nonmetallic body 22 provides an enhanced club performance. The golfer senses this enhancement as a tactile response through the clubhead handle 14 as well as an audible response when the striking surface 30 of the body 22 optimally impacts the ball. The audible and tactile responses appears to be optimized when the striking surface 30 engages the ball at the target location 48 diagrammically shown in FIG. 2 thus providing a indication of golfer performance.

There is a wide range of golf putter styles including relatively small blades to more massive mallets. Consequently the depth of the clubhead also varies. One popular style is the blade and shelf style as shown herein, although the invention can be applied by one skilled in the art to most styles including the various styles shown and described in U.S. patent application Ser. No. 09/618,076 incorporated herein by reference.

In the examples shown herein, the clubhead is of the blade and shelf or blade and flange style and is usually about one inch or more in depth. The depth of the body 22 is preferably in a range of about 0.3 to 0.6 inch and the depth of the web 54 is in a range of about 0.08 inch to about 0.25 inch. In the preferred embodiments the body 22 is approximately one inch in height and the web 54 does not extend to the upper surface of body 22. These dimensions and ranges can vary with the clubhead style.

An alternate embodiment is shown in the sectional view of FIG. 7 taken on the line 6—6 of FIG. 4. Therein the metallic web 154 is totally surrounded by the nonmetallic body 122. In the embodiment of FIG. 7, the medial section includes rear shelf 152 corresponding to the shelf 52 of FIG. 6 but it is disconnected and isolated from the web 154. The web 154 is connected to an armature within the hosel 18 at a location corresponding to section line 8—8 of FIG. 4 in the manner already described with respect to the embodiment of FIGS. 6 and 8. In all of the embodiments disclosed the striking surface 30 of the body 22 is canted for loft at a small acute angle in the order of two to five degrees relative to the sole surface 44.

Figure 9:
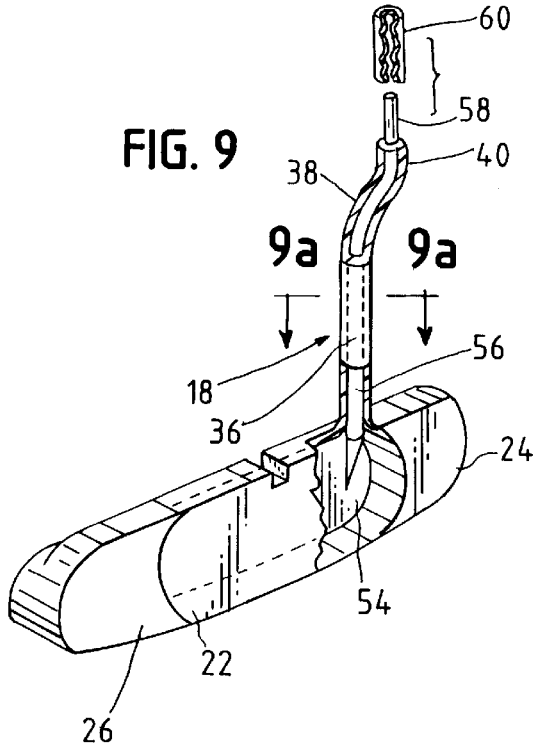
FIG. 9 is an exploded perspective view partly in section of one embodiment of the invention shown in FIG. 1.
Figure 9A:
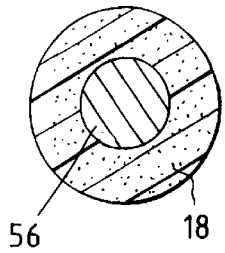
FIG. 9*a* is a cross-section of the hosel portion of the invention of FIG. 1 taken on the line 9*a*—9*a* of FIG. 9.
Figure 11:
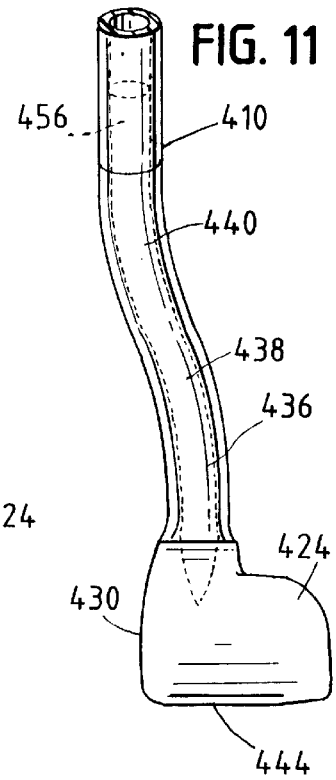
FIG. 11 is a side elevation of the embodiment of FIG. 10.

The manner in which the metallic web and armature are incorporated within the nonmetallic body in cooperation with the hosel and shaft is illustrated in FIGS. 9–11. Specifically referring to FIG. 9, the armature 56 is secured to and integral with the web 54 within the nonmetallic body 22. The body 22 and the hosel 18 are partially broken away to illustrate that interconnection. The armature 56 extends upwardly through the various sections of the hosel 18 providing a connector stud 58 to receive and support a club shaft 60 (partially shown cut away). FIG. 9*a* shows the cross sectional configuration of the hosel 18 along the line 9*a*—9*a* in FIG. 9. In FIG. 9*a* the metallic armature 56 is shown enclosed within the composite hosel 18.

In a preferred embodiment shown in FIG. 10 the armature 456 is shown within the hosel 418. The armature 456 is shown connected to the metallic web 454 within the nonmetallic body 422. As in the other embodiments, the body 422 is formed to receive the web 454 and is formed between and secured to the heel end 424 and toe end 426 of the shell 428.

Figure 12:
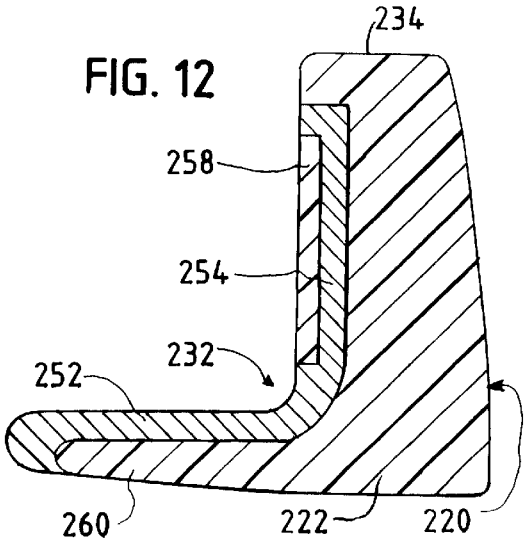
FIG. 12 is a sectional view of an alternate embodiment of the invention of FIG. 1 similar to that shown in FIGS. 2–5 and taken on the line 6—6 of FIG. 4.
Figure 13:
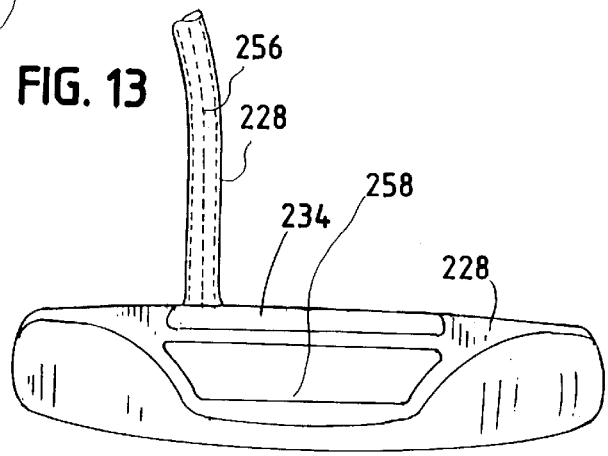
FIG. 13 is a fragmentary rear elevation of the embodiment of FIG. 12.
Figure 14:
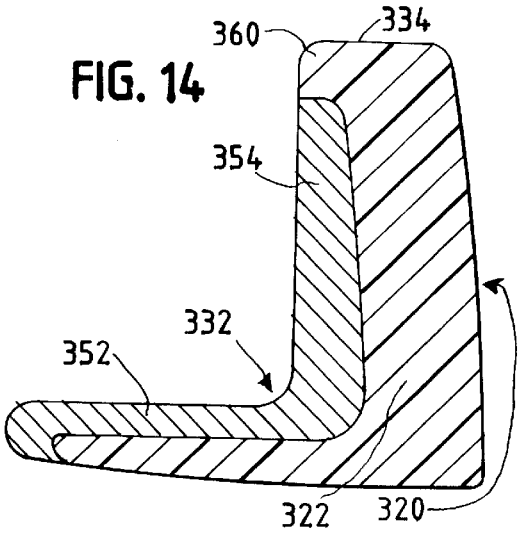
FIG. 14 is a cross-section of another embodiment of the invention of FIG. 1 similar to that shown in FIGS. 2–5 taken on the line 6—6 of FIG. 4.

The armature 456 extends beyond the hosel 418 to integrate the body 422, hosel 418 and shaft 410. The shaft 410, hosel 418 and body 422 are formed of the same basic material, graphite fibers and plastic resin, in the preferred embodiment. The preferred fabrication method for the putter includes several forming steps. The metal shell 428 with the polar heel portion 424, polar toe portion 426 and interconnecting medial section including web 454 is first formed. The body 422 and hosel 418 are then formed of a plastic resin containing graphite fibers to create a component integrated with the web 454 and the lower part of armature 456. The metal shell and the body/hosel resin component comprise the clubhead. In the embodiments of FIGS. 6–8 the shell 428 comprises an insert in the formation of the body/hosel. In the embodiments of FIGS. 12–14, it is not necessary to form the clubhead with the metal shell as an insert, but the shell and the body/hosel can be formed separately and secured together by an adhesive. Rolling a lamination comprising several biased layers of resin pre-impregnated long fiber graphite sheets around a tapered mandrel forms the club shaft 410. After curing, the shaft 410 is removed from the tapered mandrel. A resin adhesive is applied to the upper end of the hosel 418 and the armature 456 and to the inside lower extremity of the shaft 410. The adhesive coated components are next assembled together in a suitable alignment holding fixture and cured. After removal from the alignment fixture, a complete putter has been formed, requiring only the addition of an appropriate handle and any desired finishing and ornamentation. The sequence of steps may be varied to provide the integrated composite body/hosel/shaft component combined with the metal shell and web.

FIG. 11 is a side elevation of the embodiment of FIG. 10. The functions and positions of the various components of the complete putter including the three portions 436, 438 and 440 of hosel 418 are best understood from a consideration of FIGS. 10 and 11 together. Specifically, the lie angle of shaft 410, the loft angle of striking surface 430, and the forward offset of hosel 418 for better alignment with the center of the ball and toe to heel alignment with the target can be best understood from FIGS. 10 and 11. The toe side 437 of lower hosel portion 436 is flattened as an additional alignment aid as previously described.

Two additional embodiments of the invention are shown in FIGS. 12–14. In most respects, these embodiments can be fully understood from the description of the embodiments of FIGS. 6, 7 and 8. However, in the embodiment of FIG. 12 the metallic web 254 is formed with a recess 258 which is filled with the material of body 222 and the surrounding portions of web 254 provide a picture window effect. The web 254 is embedded in the back surface of body 222. The clubhead of FIG. 12 includes a rear shelf 252 corresponding to that shown in the prior embodiments and the body 222 includes a sole portion 260 corresponding to the sole portion 60 shown in FIGS. 6–8 The appearance of the embodiment of FIG. 12 in a rear elevation is shown in FIG. 13. Therein the nonmetallic picture-like area 258 is illustrated surrounded by portions of the metal shell 228. The top surface 234 of the body 222 is shown with the hosel 228 extending upwardly therefrom. Broken lines in FIG. 13 indicate the armature 256.

The additional embodiment of FIG. 14 is similar to that of FIGS. 12 and 13. However, the picture cavity 258 of FIG. 12 is omitted and a web 354 is embedded in and formed as a part of the rear surface of the body 322. A rear portion 360 of body 322 appears above the web 354 and includes the aligning groove in surface 334 as described in the preceding embodiments. The rear body portion 360 may be shaped for aesthetic purposes. Thus the rear body surface 362 may have a curved appearance.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A golf club comprising:

an elongate shaft having a player gripping end and a clubhead end; and a clubhead extending from said clubhead end, said clubhead having a heel, a toe, a sole and a top and a striking face therebetween, said clubhead including:

a shell including a distal toe portion, a distal heel portion spaced from said toe portion, surfaces of said distal toe portion and distal heel portion defining surface portions of said sole, top and striking surface, an elongate medial portion extending between said toe portion and said heel portion comprising a web, the material of said shell having relatively high mass density and the size and shape of said heel portion and said toe portion being selected to provide mass concentration at the heel end and the toe end of said clubhead; and an elongate body and a hosel, formed of relatively low mass density material, said body extending longitudinally between said distal shell portions and defining a central striking surface portion of said striking face and an upper surface portion of said top, said hosel extending upwardly from said upper surface, and said web being in said body; and a hosel armature embedded in said body, encased in said hosel and extending upwardly from said upper surface into said clubhead end of said shaft.

2. The golf club of claim 1 wherein said body and said hosel are formed as a single piece.

3. The golf club of claim 2 wherein said shaft is formed of said relatively low mass density material.

4. The golf club of claim 3 wherein the body, the hosel and the shaft are formed of graphite fibers and resin.

5. The golf club of claim 4 wherein said body extends to and defines a sole surface portion of said sole.

6. The golf club of claim 2 wherein said body and hosel and said shaft are formed of a graphite composite.

7. The golf club of claim 2 wherein the body and the hosel are formed of a composite including glass fibers and a resin.

8. The golf club of claim 2 wherein said upper surface is aligned with said striking surface, visible to a player gripping said player gripping end of said shaft and oriented to the shaft as a sighting aid.

9. The golf club of claim 8 wherein said upper surface includes an indicium identifying a target location longitudinally spaced from the hosel.

10. The golf club of claim 2 wherein said medial portion includes a shelf longitudinally extending between said toe portion and said heel portion and extending rearwardly from said body.

11. The golf club of claim 10 wherein said shelf and said web are formed integrally.

12. The golf club of claim 10 wherein said shelf and said web extend longitudinally and define a longitudinal space therebetween.

13. The golf club of claim 2 wherein said body defines a back surface behind said striking surface.

14. The golf club of claim 2 wherein said web defines a portion of said back surface spaced from said striking surface.

15. The golf club of claim 1 wherein the cross section of said web is behind said striking surface and below said upper surface.

16. The golf club of claim 1 wherein said striking face is a segment of a longitudinal cylindrical surface having a convex cross section.

17. A golf club comprising:

an elongate shaft having a player gripping end, a clubhead end and a longitudinal axis; and a clubhead extending from said clubhead end, said clubhead having a heel, a toe, a sole and a top and a striking face therebetween, said clubhead including:

a shell formed of metallic material including a distal toe portion, a distal heel portion spaced from said toe portion, surfaces of said distal toe portion and distal heel portion defining surface portions of said sole, top and striking surface, an elongate medial portion between said toe portion and said heel portion comprising a web extending less than the distance between said top and said sole and spaced from said striking surface, the material of said shell and the size and shape of said heel portion and said toe portion being selected to provide mass concentration at the heel end and the toe end of said clubhead;

an elongate body and a hosel, formed of non-metallic material, said body extending longitudinally between said distal shell portions and containing said web, said body defining an upper surface portion of said top and a striking surface portion of said striking face, and said hosel extending upwardly from said upper surface and having an intermediate offset portion; and a hosel armature embedded in said body, encased in said hosel and extending upwardly from said upper surface into said clubhead end of said shaft.

18. The golf club of claim 17 wherein said offset portion is transverse to said shaft.

19. The golf club of claim 17 wherein said offset portion forms a small acute angle relative to said shaft.

20. The golf club of claim 19 wherein said striking surface is generally aligned with and forms a large acute angle with said sole surface.

21. The golf club of claim 17 wherein said body extends to said sole and defines a sole surface portion of said sole.

22. The golf club of claim 21 wherein said shaft is formed of the same non-metallic material as said combined elongate body and hosel and is integral therewith.

23. The golf club of claim 17 wherein said elongate body and hosel are formed of the same material as a single piece.

24. The golf club of claim 23 wherein said shaft and said combined body and hosel are formed of a graphite composite.

25. A golf club comprising:

an elongate shaft having a player gripping end and a clubhead end; and a clubhead extending from said clubhead end, said clubhead having a heel, a toe, a sole and a top and a striking face therebetween, said clubhead including:

a shell including a distal toe portion, a distal heel portion spaced from said toe portion, surfaces of said distal toe portion and distal heel portion defining surface portions of said sole, top and striking surface, an elongate medial portion extending between said toe portion and said heel portion comprising a web, the material of said shell having relatively high mass density and the size and shape of said heel portion and said toe portion being selected to provide mass concentration at the heel end and the toe end of said clubhead; and an elongate body and a hosel, formed of relatively low mass density material, said body extending longitudinally between said distal shell portions and defining a striking surface portion of said striking face and an upper surface portion of said top, said web being in said body and said hosel extending upwardly from said upper surface portion and extending downwardly from said clubhead end of said shaft.

26. A golf club comprising:

an elongate shaft having a player gripping end and a clubhead end;

a clubhead extending from said clubhead end, said clubhead having a heel, a toe, a sole and a top and a striking face therebetween, said clubhead including:

a shell including a distal toe portion, a distal heel portion spaced from said toe portion, surface portions of said distal toe portion and distal heel portion defining surfaces of said sole, top and striking surface, an elongate medial portion extending between said toe portion and said heel portion comprising a web, the material of said shell having relatively high mass density and the size and shape of said heel portion and said toe portion being selected to provide mass concentration at the heel end and the toe end of said clubhead;

an elongate body and a hosel, formed of relatively low mass density material, said body extending longitudinally between said distal shell portions and defining a striking surface portion of said striking face, said web being in said body; and a hosel armature embedded in said body, encased in said hosel and extending upwardly from said upper surface into said clubhead end of said shaft.

* * * * *